US011808045B2

(12) United States Patent
Boo et al.

(10) Patent No.: US 11,808,045 B2
(45) **Date of Patent: *Nov. 7, 2023**

(54) SET OF PANELS

(71) Applicant: Välinge Innovation AB, Viken (SE)

(72) Inventors: Christian Boo, Kagerod (SE); Marcus Nilsson Ståhl, Höganäs (SE); Anders Nilsson, Helsingborg (SE)

(73) Assignee: VÄLINGE INNOVATION AB, Viken (SE)

( * ) Notice: Subject to any disclaimer, the term of this patent is extended or adjusted under 35 U.S.C. 154(b) by 501 days.

This patent is subject to a terminal disclaimer.

(21) Appl. No.: 17/017,085

(22) Filed: Sep. 10, 2020

(65) Prior Publication Data

US 2020/0407981 A1 Dec. 31, 2020

Related U.S. Application Data

(63) Continuation of application No. 16/220,748, filed on Dec. 14, 2018, now Pat. No. 10,808,410.

(30) Foreign Application Priority Data

Jan. 9, 2018 (SE) ..... 1850026-4

(51) Int. Cl.
*E04F 15/02* (2006.01)
*E04F 15/10* (2006.01)
*E04F 13/08* (2006.01)

(52) U.S. Cl.
CPC ..... *E04F 15/02038* (2013.01); *E04F 13/08* (2013.01); *E04F 15/02033* (2013.01);
(Continued)

(58) Field of Classification Search
CPC . E04F 15/02038; E04F 15/102; E04F 15/105; E04F 15/107; E04F 2201/0107;
(Continued)

(56) References Cited

U.S. PATENT DOCUMENTS 1,787,027 A 12/1930 Wasleff
3,120,083 A 2/1964 Dahlberg et al.
(Continued)

FOREIGN PATENT DOCUMENTS

DE 2 251 762 5/1974
DE 202 07 844 U 8/2002
(Continued)

OTHER PUBLICATIONS

U.S. Appl. No. 17/694,843, Mats Nilsson and Per Nygren, filed Mar. 15, 2022
(Continued)

*Primary Examiner* — Adriana Figueroa
(74) *Attorney, Agent, or Firm* — Boone IP Law

(57) ABSTRACT

A set of panels including first and second panels. The first and second panels have a first, second and third edge. The first edge of the first panel is configured to be able to be locked together with both the second edge and the third edge of the second panel. The first edge includes a first locking element configured to be able to cooperate with a first locking groove at the second edge and a second locking groove at the third edge for locking in a horizontal direction. The first edge includes a tongue groove configured to cooperate with a tongue at the second edge and a tongue at the third edge for locking in a vertical direction. The first locking element includes a first locking surface configured to cooperate with a second locking surface on the first locking groove, for locking in the horizontal and the vertical direction.

20 Claims, 10 Drawing Sheets

(52) U.S. Cl.
CPC ..... *E04F 15/102* (2013.01); *E04F 15/105* (2013.01); *E04F 15/107* (2013.01); *E04F 2201/0107* (2013.01); *E04F 2201/0146* (2013.01); *E04F 2201/0153* (2013.01); *E04F 2201/0161* (2013.01); *E04F 2201/023* (2013.01)

(58) Field of Classification Search
CPC ..... E04F 2201/0146; E04F 2201/0153; E04F 2201/0161; E04F 2201/023
See application file for complete search history.

(56) References Cited

U.S. PATENT DOCUMENTS 3,247,638 A 4/1966 Gay et al.
3,538,665 A 11/1970 Gohner
3,694,983 A 10/1972 Couquet
3,720,027 A 3/1973 Christensen
3,742,669 A 7/1973 Mansfeld
3,760,547 A 9/1973 Brenneman
3,857,749 A 12/1974 Yoshida
3,919,820 A 11/1975 Green
4,113,399 A 9/1978 Hansen, Sr. et al.
4,172,169 A 10/1979 Mawson et al.
4,176,210 A 11/1979 Skinner
4,180,615 A 12/1979 Bettoli
4,187,131 A 2/1980 Shortway et al.
4,196,554 A 4/1980 Anderson et al.
4,313,866 A 2/1982 Renshaw
4,333,987 A 6/1982 Kwart et al.
4,393,187 A 7/1983 Boba et al.
4,423,178 A 12/1983 Renshaw
4,426,820 A 1/1984 Terbrack et al.
4,489,115 A 12/1984 Layman et al.
4,507,188 A 3/1985 Chu
4,512,131 A 4/1985 Laramore
4,599,841 A 7/1986 Haid
4,614,680 A 9/1986 Fry et al.
4,772,500 A 9/1988 Stroppiana
4,785,065 A 11/1988 Uhl et al.
4,807,412 A 2/1989 Frederiksen
5,007,222 A 4/1991 Raymond
5,112,671 A 5/1992 Diamond et al.
5,148,850 A 9/1992 Urbanick
5,162,141 A 11/1992 Davey et al.
5,182,892 A 2/1993 Chase
5,344,700 A 9/1994 McGath et al.
5,380,794 A 1/1995 Schaefer et al.
5,441,677 A 8/1995 Phillips, Sr.
5,458,953 A 10/1995 Wang et al.
5,465,546 A 11/1995 Buse
5,548,937 A 8/1996 Shimonohara
5,618,602 A 4/1997 Nelson
5,630,304 A 5/1997 Austin
5,670,237 A 9/1997 Shultz et al.
5,694,730 A 12/1997 Del Rincon et al.
5,797,237 A 8/1998 Finkell, Jr.
5,950,389 A 9/1999 Porter
6,006,486 A 12/1999 Moriau et al.
6,052,960 A 4/2000 Yonemura
6,065,262 A 5/2000 Motta
6,101,778 A 8/2000 Martensson
6,139,945 A 10/2000 Krejchi et al.
6,173,548 B1 1/2001 Hamar et al.
6,182,410 B1 2/2001 Pervan
6,209,278 B1 4/2001 Tychsen
6,216,409 B1 4/2001 Roy et al.
6,233,899 B1 5/2001 Mellert et al.
6,291,078 B1 9/2001 Chen et al.
6,324,809 B1 12/2001 Nelson
6,332,733 B1 12/2001 Hamberger et al.
6,345,481 B1 2/2002 Nelson
6,363,677 B1 4/2002 Chen et al.
6,455,127 B1 9/2002 Valtanen
6,490,836 B1 12/2002 Moriau et al.
6,505,452 B1 1/2003 Hannig et al.
6,536,178 B1 3/2003 Palsson et al.
6,546,691 B2 4/2003 Leopolder
6,553,724 B1 4/2003 Bigler
6,558,070 B1 5/2003 Valtanen
6,617,009 B1 9/2003 Chen et al.
6,647,690 B1 11/2003 Martensson
6,672,030 B2 1/2004 Schulte
6,675,545 B2 1/2004 Chen et al.
6,729,091 B1 5/2004 Martensson
6,761,008 B2 7/2004 Chen et al.
6,763,643 B1 7/2004 Martensson
6,766,622 B1 7/2004 Thiers
6,769,218 B2 8/2004 Pervan
6,769,219 B2 8/2004 Schwitte et al.
6,772,568 B2 8/2004 Thiers
6,790,512 B2 9/2004 MacQueen et al.
6,804,926 B1 10/2004 Eisermann
6,851,241 B2 2/2005 Pervan
6,854,235 B2 2/2005 Martensson
6,862,857 B2 3/2005 Tychsen
6,865,855 B2 3/2005 Knauseder
6,874,292 B2 4/2005 Moriau
6,880,307 B2 4/2005 Schwitte
6,895,881 B1 5/2005 Whitaker
6,928,779 B2 8/2005 Moriau et al.
6,986,934 B2 1/2006 Chen et al.
7,051,486 B2 5/2006 Pervan
7,090,430 B1 8/2006 Fletcher
7,121,058 B2 10/2006 Palsson et al.
7,155,871 B1 1/2007 Stone et al.
7,169,460 B1 1/2007 Chen et al.
7,171,791 B2 2/2007 Pervan
7,211,310 B2 5/2007 Chen et al.
7,251,916 B2 8/2007 Konzelmann et al.
7,275,350 B2 10/2007 Pervan et al.
7,337,588 B1 3/2008 Moebus
7,377,081 B2 5/2008 Ruhdorfer
7,398,625 B2 7/2008 Pervan
7,419,717 B2 9/2008 Chen et al.
7,451,578 B2 11/2008 Hannig
7,454,875 B2 11/2008 Pervan et al.
7,484,337 B2 2/2009 Hecht
7,552,568 B2 6/2009 Palsson et al.
7,568,322 B2 8/2009 Pervan et al.
7,584,583 B2 9/2009 Bergelin et al.
7,603,826 B1 10/2009 Moebus
7,607,271 B2 10/2009 Griffin et al.
7,614,197 B2 11/2009 Nelson
7,617,645 B2 11/2009 Moriau et al.
7,621,094 B2 11/2009 Moriau et al.
7,634,886 B2 12/2009 Moriau et al.
7,634,887 B2 12/2009 Moriau et al.
7,637,066 B2 12/2009 Moriau et al.
7,640,708 B2 1/2010 Moriau et al.
7,644,555 B2 1/2010 Moriau et al.
7,644,557 B2 1/2010 Moriau et al.
7,647,743 B2 1/2010 Moriau et al.
7,650,728 B2 1/2010 Moriau et al.
7,654,054 B2 2/2010 Moriau et al.
7,658,048 B2 2/2010 Moriau et al.
7,677,001 B2 3/2010 Pervan
7,678,215 B2 3/2010 Martin
7,716,896 B2 5/2010 Pervan
7,739,849 B2 6/2010 Pervan
7,763,345 B2 7/2010 Chen et al.
7,779,597 B2 8/2010 Thiers et al.
7,802,415 B2 9/2010 Pervan
7,841,144 B2 11/2010 Pervan
7,841,150 B2 11/2010 Pervan
7,856,784 B2 12/2010 Martensson
7,856,789 B2 12/2010 Eisermann
7,861,482 B2 1/2011 Pervan
7,866,110 B2 1/2011 Pervan
7,886,497 B2 2/2011 Pervan et al.
7,896,571 B1 3/2011 Hannig et al.
7,930,862 B2 4/2011 Bergelin et al.
7,958,689 B2 6/2011 Lei

(56) References Cited

U.S. PATENT DOCUMENTS

| | | | |
|---|---|---|---|
| 7,980,043 | B2 | 7/2011 | Moebus |
| 7,984,600 | B2 | 7/2011 | Alford et al. |
| 8,006,460 | B2 | 8/2011 | Chen et al. |
| 8,021,741 | B2 | 9/2011 | Chen et al. |
| 8,028,486 | B2 | 10/2011 | Pervan |
| 8,037,656 | B2 | 10/2011 | Liu |
| 8,038,363 | B2 | 10/2011 | Hannig |
| 8,042,311 | B2 | 10/2011 | Pervan et al. |
| 8,071,193 | B2 | 12/2011 | Windmöller |
| 8,091,238 | B2 | 1/2012 | Hannig |
| 8,099,924 | B2 | 1/2012 | Braun |
| 8,112,891 | B2 | 2/2012 | Pervan |
| 8,132,384 | B2 | 3/2012 | Hannig |
| 8,166,718 | B2 | 5/2012 | Liu |
| 8,191,333 | B2 | 6/2012 | Braun |
| 8,196,366 | B2 | 6/2012 | Thiers |
| 8,215,078 | B2 | 7/2012 | Pervan |
| 8,234,829 | B2 | 8/2012 | Thiers et al. |
| 8,245,478 | B2 | 8/2012 | Bergelin et al. |
| 8,281,549 | B2 | 10/2012 | Du |
| 8,293,058 | B2 | 10/2012 | Pervan et al. |
| 8,353,140 | B2 | 1/2013 | Pervan et al. |
| 8,356,452 | B2 | 1/2013 | Thiers et al. |
| 8,365,499 | B2 | 2/2013 | Nilsson et al. |
| 8,375,672 | B2 | 2/2013 | Hannig |
| 8,375,674 | B2 | 2/2013 | Braun |
| 8,480,841 | B2 | 7/2013 | Pervan et al. |
| 8,484,924 | B2 | 7/2013 | Braun |
| 8,490,361 | B2 | 7/2013 | Curry et al. |
| 8,499,521 | B2 | 8/2013 | Pervan et al. |
| 8,511,031 | B2 | 8/2013 | Bergelin et al. |
| 8,544,231 | B2 | 10/2013 | Hannig |
| 8,544,232 | B2 | 10/2013 | Wybo et al. |
| 8,544,234 | B2 | 10/2013 | Pervan et al. |
| 8,584,423 | B2 | 11/2013 | Pervan et al. |
| 8,613,826 | B2 | 12/2013 | Pervan et al. |
| 8,658,274 | B2 | 2/2014 | Chen et al. |
| 8,707,651 | B2 | 4/2014 | Stockl |
| 8,720,149 | B2 | 5/2014 | Bossuyt |
| 8,726,604 | B2 | 5/2014 | Hannig |
| 8,745,952 | B2 | 6/2014 | Perra et al. |
| 8,756,899 | B2 | 6/2014 | Nilsson et al. |
| 8,763,340 | B2 | 7/2014 | Pervan et al. |
| 8,800,150 | B2 | 8/2014 | Pervan |
| 8,806,832 | B2 | 8/2014 | Kell |
| 8,833,028 | B2 | 9/2014 | Whispell et al. |
| 8,834,992 | B2 | 9/2014 | Chen et al. |
| 8,952,078 | B2 | 2/2015 | Gould |
| 8,966,853 | B2 | 3/2015 | Hannig |
| 8,978,336 | B2 | 3/2015 | Perra |
| 9,103,126 | B2 | 8/2015 | Kell |
| 9,212,492 | B2 | 12/2015 | Pervan et al. |
| 9,217,250 | B2 | 12/2015 | Perra |
| 9,222,267 | B2 | 12/2015 | Bergelin et al. |
| 9,228,360 | B2 | 1/2016 | Schneider |
| 9,249,581 | B2 | 2/2016 | Nilsson et al. |
| 9,260,870 | B2 | 2/2016 | Vermeulen et al. |
| 9,296,191 | B2 | 3/2016 | Pervan et al. |
| 9,314,936 | B2 | 4/2016 | Pervan |
| 9,371,653 | B2 | 6/2016 | Liu |
| 9,410,328 | B2 | 8/2016 | Pervan |
| 9,528,278 | B2 | 12/2016 | Cappelle |
| 9,650,792 | B2 | 5/2017 | Ramachandra |
| 9,695,600 | B2 | 7/2017 | Vandevoorde |
| 9,695,601 | B2 | 7/2017 | Whispell et al. |
| 9,695,851 | B2 | 7/2017 | Hannig |
| 9,714,515 | B2 | 7/2017 | Pervan |
| 9,745,758 | B2 | 8/2017 | Baert et al. |
| 9,765,530 | B2 | 9/2017 | Bergelin et al. |
| 9,777,487 | B2 | 10/2017 | Pervan et al. |
| 9,803,374 | B2 | 10/2017 | Pervan |
| 9,816,270 | B2 | 11/2017 | Pervan et al. |
| 9,874,035 | B2 | 1/2018 | Wagner |
| 9,885,186 | B2 | 2/2018 | Liu |
| 9,885,187 | B2 | 2/2018 | Kell |
| 10,000,935 | B2 | 6/2018 | Kell |
| 10,047,527 | B2 | 8/2018 | Nilsson et al. |
| 10,059,084 | B2 | 8/2018 | Lundblad et al. |
| 10,113,318 | B2 | 10/2018 | Cappelle |
| 10,137,659 | B2 | 11/2018 | Pervan |
| 10,214,917 | B2 | 2/2019 | Pervan et al. |
| 10,287,777 | B2 | 5/2019 | Boo et al. |
| 10,301,830 | B2 | 5/2019 | Boo |
| 10,316,526 | B2 | 6/2019 | Kell |
| 10,344,379 | B2 | 7/2019 | Pervan |
| 10,407,919 | B2 | 9/2019 | Boo |
| 10,450,760 | B2 | 10/2019 | Bergelin et al. |
| 10,486,399 | B2 | 11/2019 | Chen et al. |
| 10,493,731 | B2 | 12/2019 | Lundblad et al. |
| 10,526,793 | B2 | 1/2020 | Nilsson et al. |
| 10,704,269 | B2 | 7/2020 | Whispell et al. |
| 10,780,676 | B2 | 9/2020 | Lundblad et al. |
| 10,808,410 | B2 | 10/2020 | Boo et al. |
| 10,837,181 | B2 | 11/2020 | Josefsson et al. |
| 10,844,612 | B2 | 11/2020 | Boo |
| 10,851,549 | B2 | 12/2020 | Boo |
| 10,865,571 | B2 | 12/2020 | Kell |
| 10,975,580 | B2 | 4/2021 | Pervan et al. |
| 10,982,449 | B2 | 4/2021 | Kell |
| 11,066,836 | B2 | 7/2021 | Bergelin et al. |
| 2001/0021431 | A1 | 9/2001 | Chen |
| 2002/0007606 | A1 | 1/2002 | Kettler |
| 2002/0007608 | A1 | 1/2002 | Pervan |
| 2002/0007609 | A1 | 1/2002 | Pervan |
| 2002/0031646 | A1 | 3/2002 | Chen |
| 2002/0069611 | A1 | 6/2002 | Leopolder |
| 2002/0092263 | A1 | 7/2002 | Schulte |
| 2002/0142135 | A1 | 10/2002 | Chen et al. |
| 2002/0152707 | A1 | 10/2002 | Martensson |
| 2002/0170258 | A1 | 11/2002 | Schwitte et al. |
| 2002/0178674 | A1 | 12/2002 | Pervan |
| 2002/0178681 | A1 | 12/2002 | Zancai |
| 2002/0189183 | A1 | 12/2002 | Ricciardelli |
| 2003/0009971 | A1 | 1/2003 | Palmberg |
| 2003/0024199 | A1 | 2/2003 | Pervan |
| 2003/0024200 | A1 | 2/2003 | Moriau et al. |
| 2003/0037504 | A1 | 2/2003 | Schwitte et al. |
| 2003/0041545 | A1 | 3/2003 | Stanchfield |
| 2003/0101674 | A1 | 6/2003 | Pervan et al. |
| 2003/0101681 | A1 | 6/2003 | Tychsen |
| 2003/0110720 | A1 | 6/2003 | Berard et al. |
| 2003/0180091 | A1 | 9/2003 | Stridsman |
| 2003/0188504 | A1 | 10/2003 | Eisermann |
| 2003/0196405 | A1 | 10/2003 | Pervan |
| 2003/0224147 | A1 | 12/2003 | Maine et al. |
| 2004/0031225 | A1 | 2/2004 | Fowler |
| 2004/0031227 | A1 | 2/2004 | Knauseder |
| 2004/0060255 | A1 | 4/2004 | Knauseder |
| 2004/0068954 | A1 | 4/2004 | Martensson |
| 2004/0128934 | A1 | 7/2004 | Hecht |
| 2004/0137180 | A1 | 7/2004 | Sjoberg et al. |
| 2004/0139678 | A1 | 7/2004 | Pervan |
| 2004/0177584 | A1 | 9/2004 | Pervan |
| 2004/0182036 | A1 | 9/2004 | Sjoberg et al. |
| 2004/0206036 | A1 | 10/2004 | Pervan |
| 2004/0211143 | A1 | 10/2004 | Hanning |
| 2004/0211144 | A1 | 10/2004 | Stanchfield |
| 2004/0219339 | A1 | 11/2004 | Dempsey et al. |
| 2004/0241374 | A1 | 12/2004 | Thiers |
| 2004/0255538 | A1 | 12/2004 | Ruhdorfer |
| 2004/0255541 | A1 | 12/2004 | Thiers et al. |
| 2004/0261348 | A1 | 12/2004 | Vulin |
| 2005/0003160 | A1 | 1/2005 | Chen et al. |
| 2005/0028474 | A1 | 2/2005 | Kim |
| 2005/0112320 | A1 | 5/2005 | Wright |
| 2005/0138881 | A1 | 6/2005 | Pervan |
| 2005/0144881 | A1 | 7/2005 | Tate et al. |
| 2005/0166514 | A1 | 8/2005 | Pervan |
| 2005/0176321 | A1 | 8/2005 | Crette et al. |
| 2005/0193677 | A1 | 9/2005 | Vogel |
| 2005/0208255 | A1 | 9/2005 | Pervan |
| 2005/0210810 | A1 | 9/2005 | Pervan |
| 2005/0221073 | A1 | 10/2005 | Liou |
| 2005/0235593 | A1 | 10/2005 | Hecht |

(56) References Cited

U.S. PATENT DOCUMENTS

2005/0247000 A1 11/2005 Zhu
2005/0250921 A1 11/2005 Qiu et al.
2005/0252130 A1 11/2005 Martensson
2005/0268570 A2 12/2005 Pervan
2006/0010820 A1 1/2006 Schwitte
2006/0032168 A1 2/2006 Thiers et al.
2006/0032175 A1 2/2006 Chen et al.
2006/0053724 A1 3/2006 Braun et al.
2006/0070333 A1 4/2006 Pervan
2006/0101769 A1 5/2006 Pervan et al.
2006/0154015 A1 7/2006 Miller et al.
2006/0156666 A1 7/2006 Caufield
2006/0174974 A1 8/2006 Brannstrom et al.
2006/0225377 A1 10/2006 Moriau et al.
2006/0236642 A1 10/2006 Pervan
2006/0248830 A1 11/2006 Moriau et al.
2006/0248831 A1 11/2006 Moriau et al.
2006/0260252 A1 11/2006 Brice
2006/0260254 A1 11/2006 Pervan
2007/0006543 A1 1/2007 Engstrom
2007/0011981 A1 1/2007 Eisermann
2007/0022694 A1 2/2007 Chen et al.
2007/0028547 A1 2/2007 Grafenauer et al.
2007/0094986 A1 5/2007 Moriau et al.
2007/0094987 A1 5/2007 Moriau et al.
2007/0130872 A1 6/2007 Goodwin
2007/0151189 A1 7/2007 Yang
2007/0151191 A1 7/2007 August
2007/0154840 A1 7/2007 Thies et al.
2007/0175148 A1 8/2007 Bergelin et al.
2007/0175156 A1 8/2007 Pervan et al.
2007/0184230 A1 8/2007 Verrue et al.
2007/0193178 A1 8/2007 Groeke et al.
2007/0196624 A1 8/2007 Chen et al.
2007/0218252 A1 9/2007 Donald
2007/0275207 A1 11/2007 Higgins et al.
2008/0000182 A1 1/2008 Pervan
2008/0000183 A1 1/2008 Bergelin et al.
2008/0000186 A1 1/2008 Pervan et al.
2008/0000188 A1 1/2008 Pervan
2008/0010931 A1 1/2008 Pervan et al.
2008/0010937 A1 1/2008 Pervan
2008/0028707 A1 2/2008 Pervan
2008/0028713 A1 2/2008 Pervan
2008/0029490 A1 2/2008 Martin, Jr. et al.
2008/0034701 A1 2/2008 Pervan
2008/0034708 A1 2/2008 Pervan
2008/0041007 A1 2/2008 Pervan
2008/0053028 A1 3/2008 Moriau et al.
2008/0060309 A1 3/2008 Moriau et al.
2008/0060310 A1 3/2008 Moriau et al.
2008/0092473 A1 4/2008 Heyns
2008/0104921 A1 5/2008 Pervan et al.
2008/0110125 A1 5/2008 Pervan
2008/0134607 A1 6/2008 Pervan
2008/0134613 A1 6/2008 Pervan
2008/0134614 A1 6/2008 Pervan
2008/0138560 A1 6/2008 Windmöller
2008/0141610 A1 6/2008 Thiers et al.
2008/0148674 A1 6/2008 Thiers et al.
2008/0153609 A1 6/2008 Kotler
2008/0172971 A1 7/2008 Pervan
2008/0184646 A1 8/2008 Alford
2008/0241440 A1 10/2008 Bauer
2008/0256890 A1 10/2008 Pervan
2008/0295432 A1 12/2008 Pervan et al.
2008/0311355 A1 12/2008 Chen et al.
2009/0031662 A1 2/2009 Chen et al.
2009/0038253 A1 2/2009 Martensson
2009/0049787 A1 2/2009 Hannig
2009/0110888 A1 4/2009 Wuest et al.
2009/0133353 A1 5/2009 Pervan et al.
2009/0151290 A1 6/2009 Liu
2009/0159156 A1 6/2009 Walker
2009/0186710 A1 7/2009 Joseph
2009/0193748 A1 8/2009 Boo
2009/0217611 A1 9/2009 Schrader
2009/0223162 A1 9/2009 Chen et al.
2009/0226662 A1 9/2009 Dyczko-Riglin et al.
2009/0235604 A1 9/2009 Cheng et al.
2009/0249733 A1 10/2009 Moebus
2009/0260313 A1 10/2009 Segaert
2009/0272058 A1 11/2009 Duselis et al.
2009/0320402 A1 12/2009 Schacht et al.
2010/0011695 A1 1/2010 Cheng
2010/0018149 A1 1/2010 Thiers
2010/0031594 A1 2/2010 Liu et al.
2010/0043333 A1 2/2010 Hannig
2010/0058702 A1 3/2010 Lei
2010/0260962 A1 10/2010 Chen et al.
2010/0293879 A1 11/2010 Pervan et al.
2010/0300029 A1 12/2010 Braun et al.
2010/0319293 A1 12/2010 Dammers et al.
2011/0001420 A1 1/2011 Tchakarov et al.
2011/0008567 A1 1/2011 Weeks et al.
2011/0030303 A1 2/2011 Pervan et al.
2011/0041996 A1 2/2011 Pervan
2011/0056167 A1 3/2011 Nilsson et al.
2011/0094178 A1 4/2011 Braun
2011/0131901 A1 6/2011 Pervan et al.
2011/0131909 A1 6/2011 Hannig
2011/0138722 A1 6/2011 Hannig
2011/0146177 A1 6/2011 Hannig
2011/0154763 A1 6/2011 Bergelin et al.
2011/0167744 A1 7/2011 Whispell et al.
2011/0173914 A1 7/2011 Engstrom
2011/0247285 A1 10/2011 Wybo
2011/0247748 A1 10/2011 Pervan et al.
2011/0258959 A1 10/2011 Braun
2011/0296780 A1 12/2011 Windmöller
2012/0003439 A1 1/2012 Chen et al.
2012/0017534 A1 1/2012 Oh
2012/0040149 A1 2/2012 Chen et al.
2012/0066996 A1 3/2012 Konstanczak
2012/0067461 A1 3/2012 Braun
2012/0124932 A1 5/2012 Schulte et al.
2012/0137617 A1 6/2012 Pervan
2012/0174519 A1 7/2012 Schulte
2012/0174521 A1 7/2012 Schulte
2012/0180416 A1 7/2012 Perra et al.
2012/0192521 A1 8/2012 Schulte
2012/0216472 A1 8/2012 Martensson
2012/0266555 A1 10/2012 Cappelle
2012/0276369 A1 11/2012 Jing et al.
2012/0279154 A1 11/2012 Bergelin et al.
2012/0304581 A1 12/2012 Kim
2013/0008118 A1 1/2013 Baert et al.
2013/0014890 A1 1/2013 Pervan et al.
2013/0025964 A1 1/2013 Ramachandra et al.
2013/0042563 A1 2/2013 Pervan et al.
2013/0042565 A1 2/2013 Pervan et al.
2013/0047536 A1 2/2013 Pervan
2013/0097959 A1 4/2013 Michel
2013/0111758 A1 5/2013 Nilsson et al.
2013/0152492 A1 6/2013 Whitaker
2013/0160391 A1 6/2013 Pervan et al.
2013/0174507 A1 7/2013 Oehrlein
2013/0212971 A1 8/2013 Cordeiro
2013/0243996 A1 9/2013 Hannig
2013/0269863 A1 10/2013 Pervan et al.
2013/0283719 A1 10/2013 Döhring et al.
2013/0298487 A1 11/2013 Bergelin et al.
2013/0305650 A1 11/2013 Liu
2013/0309441 A1 11/2013 Hannig
2013/0333182 A1 12/2013 Pervan et al.
2014/0007539 A1 1/2014 Pervan et al.
2014/0033633 A1 2/2014 Kell
2014/0033635 A1 2/2014 Pervan et al.
2014/0069043 A1 3/2014 Pervan
2014/0069044 A1 3/2014 Wallin
2014/0115994 A1 5/2014 Pervan
2014/0186104 A1 7/2014 Hamberger
2014/0215946 A1 8/2014 Roy et al.
2014/0237924 A1 8/2014 Nilsson et al.

(56) References Cited

U.S. PATENT DOCUMENTS

| | | | |
|---|---|---|---|
| 2014/0283466 | A1 | 9/2014 | Boo |
| 2014/0283477 | A1 | 9/2014 | Hannig |
| 2014/0290173 | A1 | 10/2014 | Hamberger |
| 2014/0318061 | A1 | 10/2014 | Pervan |
| 2014/0325930 | A1 | 11/2014 | Schneider |
| 2014/0352248 | A1 | 12/2014 | Whispell et al. |
| 2014/0356594 | A1 | 12/2014 | Chen et al. |
| 2014/0366476 | A1 | 12/2014 | Pervan |
| 2014/0366477 | A1 | 12/2014 | Kell |
| 2015/0114552 | A1 | 4/2015 | Cernohous et al. |
| 2015/0225964 | A1 | 8/2015 | Chen et al. |
| 2015/0252573 | A1 | 9/2015 | Devos |
| 2015/0330088 | A1 | 11/2015 | Derelöv |
| 2015/0368910 | A1 | 12/2015 | Kell |
| 2016/0016390 | A1 | 1/2016 | Lundblad et al. |
| 2016/0016391 | A1 | 1/2016 | Lundblad et al. |
| 2016/0047129 | A1 | 2/2016 | Bowers |
| 2016/0052245 | A1 | 2/2016 | Chen et al. |
| 2016/0069089 | A1 | 3/2016 | Bergelin et al. |
| 2016/0076260 | A1 | 3/2016 | Pervan et al. |
| 2016/0108624 | A1 | 4/2016 | Nilsson et al. |
| 2016/0115695 | A1 | 4/2016 | Devos |
| 2016/0138274 | A1 | 5/2016 | Anspach et al. |
| 2016/0186318 | A1 | 6/2016 | Pervan et al. |
| 2016/0194883 | A1 | 7/2016 | Pervan |
| 2016/0194885 | A1 | 7/2016 | Whispell et al. |
| 2016/0201324 | A1 | 7/2016 | Håkansson et al. |
| 2016/0265234 | A1 | 9/2016 | Pervan |
| 2016/0333595 | A1 | 11/2016 | Cappelle |
| 2016/0375674 | A1 | 12/2016 | Schulte |
| 2017/0030088 | A1 | 2/2017 | Simoens |
| 2017/0037642 | A1 | 2/2017 | Boo |
| 2017/0037645 | A1 | 2/2017 | Pervan |
| 2017/0175400 | A1 | 6/2017 | Josefsson et al. |
| 2017/0241136 | A1 | 8/2017 | Kell |
| 2017/0350140 | A1 | 12/2017 | Bergelin et al. |
| 2017/0362834 | A1 | 12/2017 | Pervan et al. |
| 2017/0370109 | A1 | 12/2017 | Devos |
| 2018/0010342 | A1 | 1/2018 | Van Hooydonck |
| 2018/0094441 | A1 | 4/2018 | Boo et al. |
| 2018/0313093 | A1 | 11/2018 | Nilsson et al. |
| 2019/0017278 | A1 | 1/2019 | De Rick et al. |
| 2019/0091977 | A1 | 3/2019 | Lundblad et al. |
| 2019/0136545 | A1 | 5/2019 | De Rick et al. |
| 2019/0211569 | A1 | 7/2019 | Boo et al. |
| 2019/0249444 | A1 | 8/2019 | Kell |
| 2019/0277041 | A1 | 9/2019 | Pervan et al. |
| 2019/0394314 | A1 | 12/2019 | Pervan et al. |
| 2020/0056379 | A1 | 2/2020 | Boo |
| 2020/0063441 | A1 | 2/2020 | Boo |
| 2020/0180282 | A1 | 6/2020 | Lundblad et al. |
| 2020/0208409 | A1 | 7/2020 | Kell |
| 2020/0248462 | A1 | 8/2020 | Bergelin et al. |
| 2020/0362567 | A1 | 11/2020 | Nilsson et al. |
| 2021/0053322 | A1 | 2/2021 | Lundblad et al. |
| 2021/0115680 | A1 | 4/2021 | Whispell et al. |
| 2021/0207385 | A1 | 7/2021 | Boo |
| 2021/0214953 | A1 | 7/2021 | Kell |
| 2021/0230881 | A1 | 7/2021 | Boo |

FOREIGN PATENT DOCUMENTS

| | | | |
|---|---|---|---|
| DE | 20 2005 004 537 | U1 | 6/2005 |
| DE | 198 54 475 | B4 | 6/2006 |
| DE | 10 2005 061 099 | A1 | 3/2007 |
| DE | 10 2006 024 184 | A1 | 11/2007 |
| DE | 20 2008 011 589 | U1 | 11/2008 |
| DE | 20 2008 012 001 | U1 | 11/2008 |
| DE | 20 2004 021 867 | U1 | 12/2011 |
| DE | 20 2016 102 034 | U1 | 5/2016 |
| EP | 1 045 083 | A1 | 10/2000 |
| EP | 1 045 083 | B1 | 10/2002 |
| EP | 1 308 577 | A2 | 5/2003 |
| EP | 1 350 904 | A2 | 10/2003 |
| EP | 1 350 904 | A3 | 10/2003 |
| EP | 1 420 125 | A2 | 5/2004 |
| EP | 1 585 875 | | 10/2005 |
| EP | 1 585 875 | B1 | 10/2006 |
| EP | 1 570 143 | | 5/2007 |
| EP | 2 339 092 | A1 | 6/2011 |
| EP | 2 615 221 | A1 | 7/2013 |
| FR | 1 293 043 04 | | 4/1962 |
| GB | 1 430 423 | A | 3/1976 |
| JP | S60-255843 | A | 12/1985 |
| JP | H07-180333 | A | 7/1995 |
| JP | H07-300979 | | 11/1995 |
| JP | H08-74405 | A | 3/1996 |
| KR | 1996-0005785 | | 7/1996 |
| KR | 10-2008-0096189 | | 10/2008 |
| KR | 10-0870496 | | 11/2008 |
| KR | 2009-0031347 | A | 3/2009 |
| WO | WO 94/26999 | A1 | 11/1994 |
| WO | WO 00/66856 | A1 | 11/2000 |
| WO | WO 01/44669 | A2 | 6/2001 |
| WO | WO 01/44669 | A3 | 6/2001 |
| WO | WO 01/48332 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/88306 | A1 | 11/2001 |
| WO | WO 03/012224 | A1 | 2/2003 |
| WO | WO 2004/011740 | A2 | 2/2004 |
| WO | WO 2004/016877 | A1 | 2/2004 |
| WO | WO 2005/068747 | A1 | 7/2005 |
| WO | WO 2005/088029 | A1 | 9/2005 |
| WO | WO 2005/098163 | A1 | 10/2005 |
| WO | WO 2006/032378 | A1 | 3/2006 |
| WO | WO 2006/043893 | A1 | 4/2006 |
| WO | WO 2006/104436 | A1 | 10/2006 |
| WO | WO 2006/123988 | A1 | 11/2006 |
| WO | WO 2006/133690 | A1 | 12/2006 |
| WO | WO 2007/015669 | A2 | 2/2007 |
| WO | WO 2007/015669 | A3 | 2/2007 |
| WO | WO 2007/016978 | A1 | 2/2007 |
| WO | WO 2007/020088 | A1 | 2/2007 |
| WO | WO 2007/079845 | A1 | 7/2007 |
| WO | WO 2007/118352 | A1 | 10/2007 |
| WO | WO 2008/008016 | A1 | 1/2008 |
| WO | WO 2008/008824 | A1 | 1/2008 |
| WO | WO 2008/068245 | A1 | 6/2008 |
| WO | WO 2008/116623 | A1 | 10/2008 |
| WO | WO 2008/133377 | A1 | 11/2008 |
| WO | WO 2009/061279 | A1 | 5/2009 |
| WO | WO 2009/071822 | A2 | 6/2009 |
| WO | WO 2009/071822 | A3 | 6/2009 |
| WO | WO 2010/015516 | A2 | 2/2010 |
| WO | WO 2010/015516 | A3 | 2/2010 |
| WO | WO 2010/072357 | A2 | 7/2010 |
| WO | WO 2010/072357 | A3 | 7/2010 |
| WO | WO 2010/081532 | A1 | 7/2010 |
| WO | WO 2010/086084 | A1 | 8/2010 |
| WO | WO 2010/114236 | A2 | 10/2010 |
| WO | WO 2010/128043 | A1 | 11/2010 |
| WO | WO 2011/012104 | A2 | 2/2011 |
| WO | WO 2011/012104 | A3 | 2/2011 |
| WO | WO 2011/028171 | A1 | 3/2011 |
| WO | WO 2011/038709 | A1 | 4/2011 |
| WO | WO 2012/084604 | A1 | 6/2012 |
| WO | WO 2012/101171 | A1 | 8/2012 |
| WO | WO 2012/126046 | A1 | 9/2012 |
| WO | WO 2012/136021 | A1 | 10/2012 |
| WO | WO 2013/017575 | A1 | 2/2013 |
| WO | WO 2013/026559 | A2 | 2/2013 |
| WO | WO 2013/044758 | A1 | 4/2013 |
| WO | WO 2013/151493 | A1 | 10/2013 |
| WO | WO 2014/007738 | A1 | 1/2014 |
| WO | WO 2014/043756 | A1 | 3/2014 |
| WO | WO 2014/182215 | A1 | 11/2014 |
| WO | WO 2014/209213 | A1 | 12/2014 |
| WO | WO 2015/174914 | A1 | 11/2015 |
| WO | WO 2016/029255 | A1 | 3/2016 |
| WO | WO 2017/101910 | A1 | 6/2017 |
| WO | WO 2017/115202 | A1 | 7/2017 |
| WO | WO 2017/187298 | A2 | 11/2017 |

(56) References Cited

FOREIGN PATENT DOCUMENTS

OTHER PUBLICATIONS

Nilsson et al., U.S. Appl. No. 17/694,843 entitled "Resilient Floor", filed Mar. 15, 2022.
Extended European Search Report dated Sep. 15, 2021 in EP 18899265.5, European Patent Office, Munich, DE, 11 pages.
U.S. Appl. No. 16/392,931, Richard William Kell, filed Apr. 24, 2019, (Cited herein as US Patent Application Publication No. 2019/0249444 A1 of Aug. 2019)..
U.S. Appl. No. 16/713,431, Mats Nilsson and Per Nygren, filed Dec. 13, 2019, (Cited herein as US Patent Application Publication No. 2020/0362567 A1 of Nov. 19, 2020).
U.S. Appl. No. 16/887,559, John W Whispell and Hao A Chen, filed May 29, 2020.
U.S. Appl. No. 17/067,989, Christian Boo, filed Oct. 12, 2020.
U.S. Appl. No. 17/076,445, Christian Boo, filed Oct. 21, 2020.
U.S. Appl. No. 17/094,226, Richard William Kell, filed Nov. 10, 2020.
U.S. Appl. No. 16/887,559, Whispell et al.
U.S. Appl. No. 17/067,989, Boo.
U.S. Appl. No. 17/076,445, Boo.
U.S. SAppl. No. 17/094,226, Kell.
International Search Report and Written Opinion, dated May 3, 2019 in PCT/SE2018/051322, Patent-och registreringsverket, Stockholm, SE 13 pages.
Pervan, Darko (Author)/Valinge Innovation, Technical Disclosure entitled "VA073a Zip Loc," Sep. 13, 2011, IP.com No. IPCOM000210869D, IP.com PriorArtDatabase, 36 pages.
Communication Pursuant to Article 94(3) EPC dated Oct. 13, 2017 in EP Patent Application No. 14 794 996.0, EPO, Munich, DE, 9 pages.
Whispell, John M., et al., U.S. Appl. No. 16/887,559 entitled "Floor Covering with Interlocking Design," filed in the U.S. Patent and Trademark Office on May 29, 2020.
Boo, Christian, U.S. Appl. No. 17/067,989 entitled "Floorboards Provided with a Mechanical Locking System," filed in the U.S. Patent and Trademark Office on Oct. 12, 2020.
Boo, Christian, U.S. Appl. No. 17/076,445 entitled "Set of Panels," filed in the U.S. Patent and Trademark Office on Oct. 21, 2020.
Kell, Richard William, U.S. Appl. No. 17/094,226 entitled "Vertical Joint System for a Surface Covering Panel," filed in the U.S. Patent and Trademark Office on Nov. 10, 2020.

SET OF PANELS

CROSS REFERENCE TO RELATED APPLICATIONS

The present application is a continuation of U.S. application Ser. No. 16/220,748, filed on Dec. 14, 2018, which claims the benefit of Swedish Application No. 1850026-4, filed on Jan. 9, 2018. The entire contents of U.S. application Ser. No. 16/220,748 and Swedish Application No. 1850026-4 are hereby incorporated herein by reference in their entirety.

TECHNICAL FIELD

The present invention relates to panels, such as floorboards, which are configured to be locked together.

BACKGROUND

Panels are known that are configured to be assembled by a vertical displacement and to be locked together in a vertical direction and in a horizontal direction. Such panels are disclosed in e.g., WO 2014/182215. A tongue and groove connection locks a first edge of a first panel to a second edge of the second panel. In addition, the first edge and the second edge include a locking element configured to cooperate with a locking groove for locking in the vertical and the horizontal direction.

WO 2005/098163 relates to a panel element comprising two different locking elements. This type of panels, however, has the disadvantage that the junction between two panels needs to be long and that a lot of panel material thereby goes to waste when producing this type of panels.

Embodiments of the present invention address a need to provide an easier assembling and/or an increased locking strength of the panels, which panels further enable laying in advanced patterns, such as in a herringbone pattern.

SUMMARY

It is an object of at least certain embodiments of the present invention to provide an improvement over the above described techniques and known art.

A further object of at least certain embodiments of the present invention is to facilitate assembling of panels configured to be assembled by a vertical displacement or an angling motion and locked together in the vertical direction and the horizontal direction.

A further object of at least certain embodiments of the present invention is to provide panels comprising only one locking element, but providing two different locking surfaces, enabling a more compact junction between panels and thereby a reduced amount of panel material going to waste.

A further object of at least certain embodiments of the present invention is to provide panels configured to be able to be locked together in such a way that not only the long edges of the panels may be locked together, or the short edges may be locked together, but also that the short edges may be locked together with the long edges, enabling laying in advanced patterns, where one example is a herringbone pattern.

At least some of these and other objects and advantages that may become apparent from the description have been achieved by a first aspect of the invention comprising a set of panels that include a first panel and a second panel, said first and second panel having a first, second and third edge.

The first edge of the first panel is configured to be able to be locked together with both the second edge and the third edge, respectively, of the second panel.

The first edge comprises a first locking element configured to be able to cooperate with a first locking groove at the second edge and a second locking groove at the third edge, respectively, for locking in a horizontal direction. The first edge further comprises a tongue groove configured to cooperate with a tongue at the second edge and a tongue at the third edge, respectively, for locking in a vertical direction. The first locking element comprises a first locking surface configured to cooperate with a second locking surface on the first locking groove for locking in the horizontal and the vertical direction. The first locking element comprises a third locking surface which is configured to cooperate with a fourth locking surface on the second locking groove for locking in the horizontal direction.

An upper part of the first edge may comprise a first guiding surface and a lower edge of the tongue of the second edge may comprise a second guiding surface, configured to cooperate during a vertical displacement of the second edge relative to the first edge for assembling the second edge to the first edge.

The tongue on the second edge may comprise an upper locking surface which is configured to cooperate for locking in a vertical direction with a lower locking surface at an upper lip of the tongue groove at the first edge.

An upper part of the first locking element may comprise a third guiding surface and a lower edge of the first locking groove may comprise a fourth guiding surface, configured to cooperate during the vertical displacement of the second edge relative to the first edge for assembling the second edge to the first edge.

The tongue at the third edge may comprise an upper locking surface which is configured to cooperate for locking in a vertical direction with the lower locking surface of the upper lip of the tongue groove at the first edge.

An angle between the first and third locking surface is preferably within the range of about 5° to about 30°, preferably within the range of about 10° to about 25°, or preferably about 17°.

An angle between the third locking surface and third guiding surface is preferably within the range of about 10° to about 40°, preferably within the range of about 20° to about 30°, or preferably about 25°.

The second edge may comprise a second locking element and the first edge may comprise a third locking groove which are configured to cooperate for locking in a horizontal direction.

The third edge may comprise a third locking element configured to cooperate with the third locking groove for locking in a horizontal direction.

The length of the second edge may be shorter than the length of the first edge.

The second edge of the second panel may be connected vertically to the first edge of the first panel.

The first panel may comprise, in a clockwise direction, the first edge, the first edge, the second edge, and the third edge.

The second panel may comprise, in a clockwise direction, the second edge, the first edge, the first edge, and the third edge.

The third edge may be configured to be assembled to the first edge by an angling motion.

The first, second, and third edge of the first and second panel is preferably produced by mechanically cutting, such as milling.

The locking surfaces and the guiding surfaces may comprise a material of the core of the first panel and/or the second panel.

The first panel and the second panel may be resilient panels. The resilient panels may comprise a core comprising thermoplastic material. The thermoplastic material may be foamed.

The thermoplastic material may comprise polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof. The core may be formed of several layers.

The first panel and the second panel may comprise a decorative layer, such as a decorative foil comprising a thermoplastic material. The thermoplastic material of the decorative layer may be or comprise polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof. The decorative foil is preferably printed, for example by direct printing, rotogravure, or digital printing.

The first panel and the second panel may comprise a wear layer such as a film or foil. The wear layer may comprise thermoplastic material. The thermoplastic material may be polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof.

Embodiments of the invention may be particularly advantageous for panels comprising guiding surfaces with higher friction and tongues comprising a less elastic thermoplastic material.

The first and the second panel may comprise a wood-based core, such as HDF, MDF or plywood.

The first panel and the second panel may be configured to be disassembled by downwardly rotating the first and/or the second panel.

BRIEF DESCRIPTION OF THE DRAWINGS

These and other aspects, features and advantages of which embodiments of the invention are capable of, will be apparent and elucidated from the following description of embodiments of the present invention, reference being made to the accompanying drawings, in which.

DETAILED DESCRIPTION

Figure 1A:
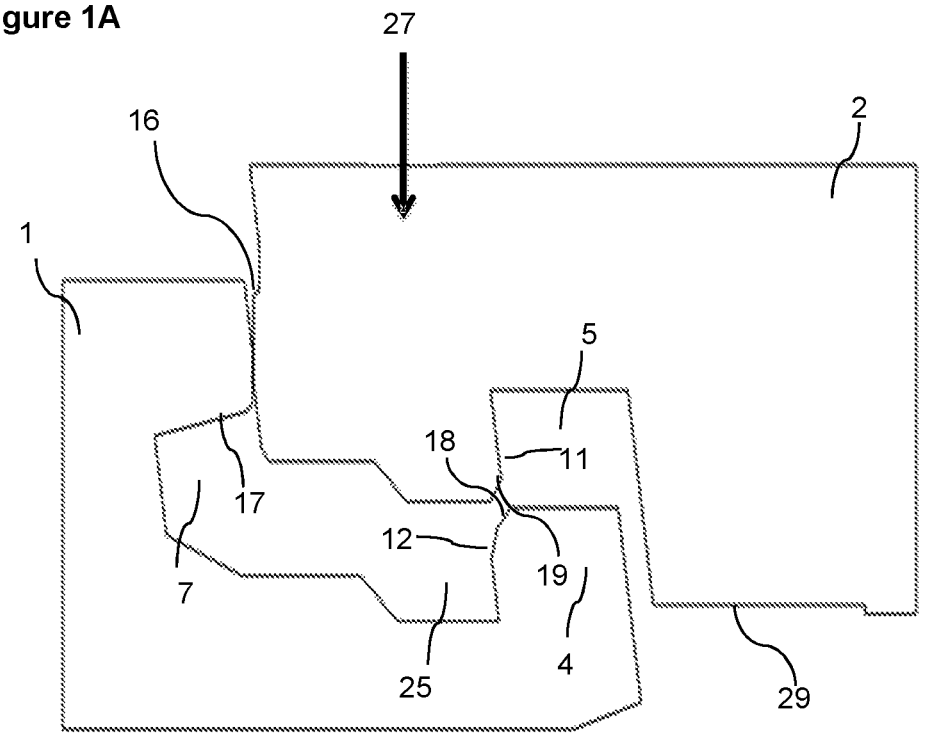
FIGS. 1A-1C show an embodiment of an assembling of an embodiment of a set of panels according to the invention, in which a first edge of a first panel and a second edge of a second panel are assembled.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to limit the invention. In the drawings, like numbers refer to like elements. When the word "about" is used in this specification in connection with a numerical value, it is intended that the associated numerical value include a tolerance of +/−10% around the stated numerical value.

Figure 1B:
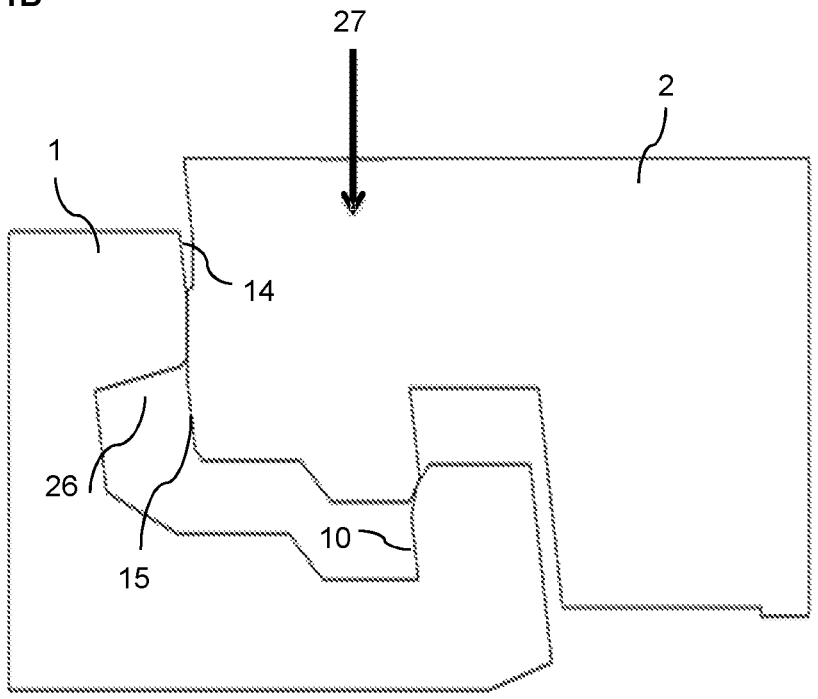
Figure 1C:
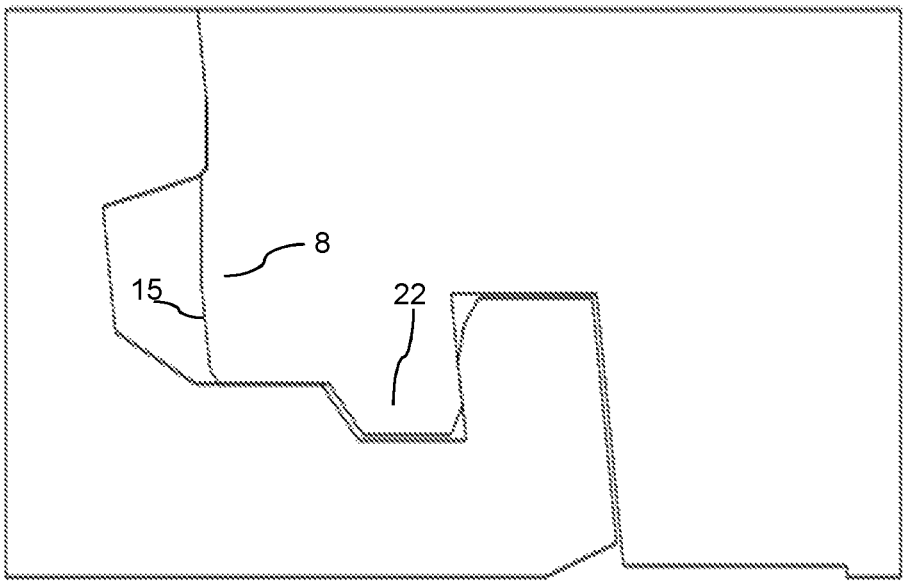
Figure 3A:
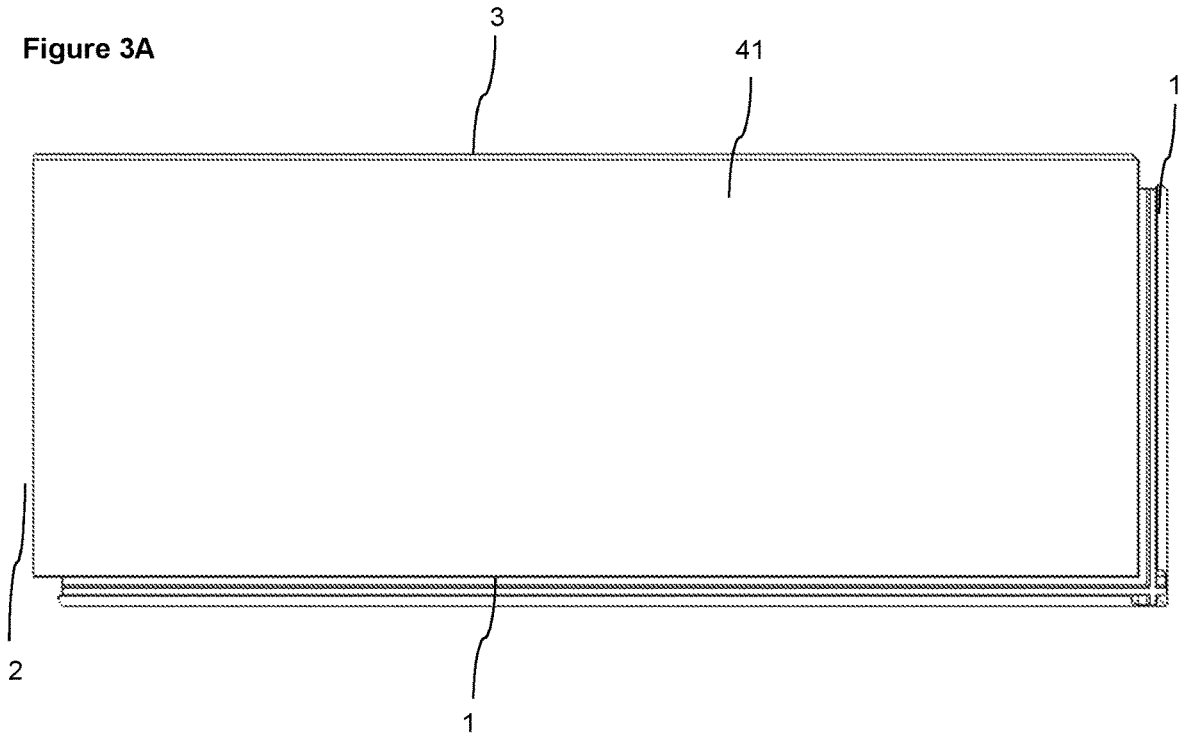
FIG. 3A shows an embodiment of a first panel according to the invention, comprising, in a clockwise direction starting from the edge to the right, the first edge, the first edge, the second edge, and the third edge.
Figure 3B:
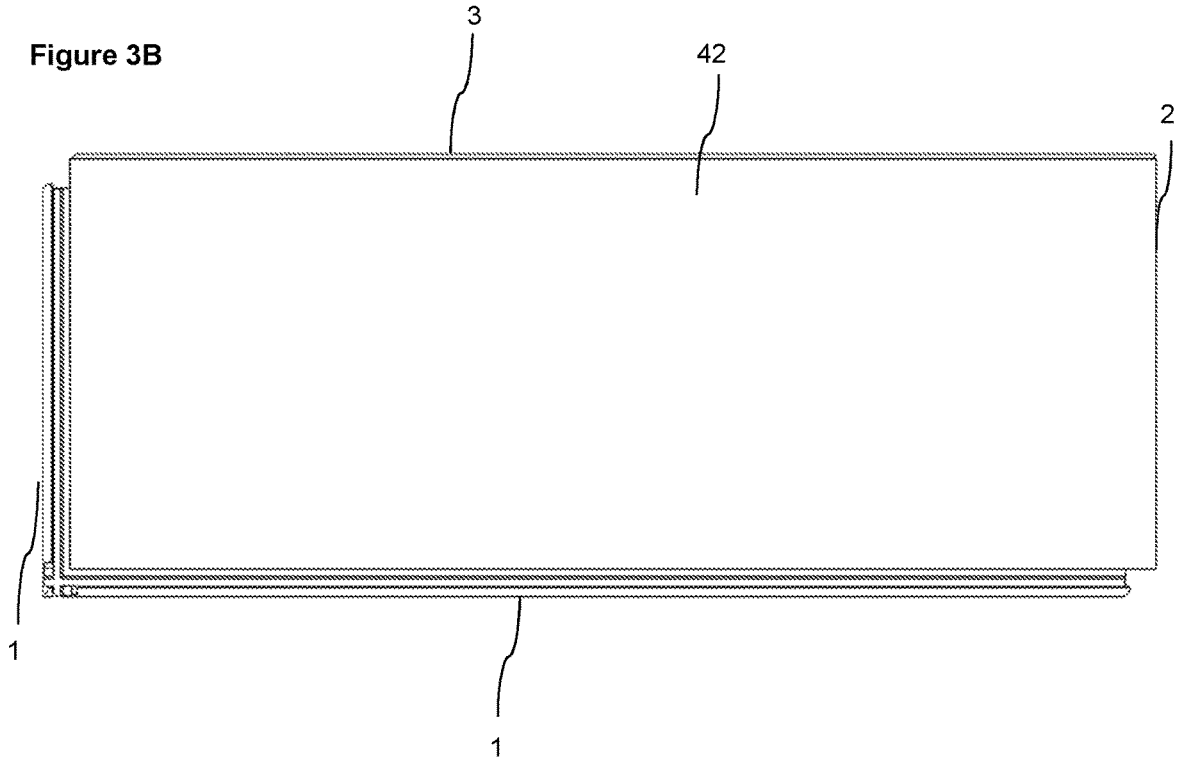
FIG. 3B shows an embodiment of a second panel according to the invention, comprising, in a clockwise direction starting from the edge to the right, the second edge, the first edge, the first edge, and the third edge.

An embodiment of the invention is shown during assembling in FIGS. 1A-1C. The embodiment comprises a set of panels comprising a first panel 41 and a second panel 42, as shown in FIGS. 3A and 3B, wherein a first edge 1 of the first panel 41 and a second edge 2 of the second panel 42 are configured to be locked together and assembled by a vertical displacement 27 of the second edge 2 of the second panel 42 relative to the first edge 1 of the first panel 41.

The first edge 1 comprises a first locking element 4 which is configured to be able to cooperate with a first locking groove 5 at the second edge 2, for locking in a horizontal direction. The first edge 1 also comprises a tongue groove 7 which is configured to cooperate with a tongue 8 at the second edge 2, for locking in a vertical direction. Further, the first locking element 4 comprises a first locking surface 10 which is configured to cooperate with a second locking surface 11 on the first locking groove 5, for locking in the horizontal and the vertical direction.

The first locking surface 10 may be parallel or essentially parallel to the second locking surface 11.

A first guiding surface 14 may be comprised on an upper part of the first edge 1, which first guiding surface 14 cooperates with a second guiding surface 15 on the lower edge of the tongue 8 during the vertical displacement 27.

The tongue 8 on the second edge 2 may comprise an upper locking surface 16 which is configured to cooperate for locking in a vertical direction with a lower locking surface 17 of an upper lip 26 of the tongue groove 7.

The locking element 4 may comprise a third guiding surface 18 and the locking groove 5 may comprise a fourth guiding surface 19. These features are configured to cooperate during the vertical displacement 27 of the second edge 2 relative to the first edge 1 for assembling the second edge 2 to the first edge 1, as shown in FIG. 1B.

The first guiding surface 14 may be parallel or essentially parallel to the second guiding surface 15.

The third guiding surface 18 may be parallel or essentially parallel to the fourth guiding surface 19.

The first and the second guiding surfaces 14,15 are configured to cooperate before the third and fourth guiding surfaces 18,19 during the vertical displacement.

The second edge 2 may comprise a second locking element 22 and the first edge 1 may comprise a third locking groove 25 which are configured to cooperate for locking in a horizontal direction.

The upper locking surface 16 is positioned above the second guiding surface 15.

The first locking surface 10 is positioned below the third guiding surface 18.

A locked position of the first edge 1 and the second edge 2 is shown in FIG. 1C. The first 1 and second edge 2 may be assembled by the vertical displacement 27.

The second edge 2 may include a lower groove 29 on the underside of the second edge 2. This lower groove 29 may provide a space to allow the second edge 2 to bend in order to allow the upper locking surface 16 and the lower locking surface 17 to lock together with greater ease.

The length of the second edge 2 is preferably shorter than the length of the first edge 1.

The vertical and horizontal lockings may be an advantage, especially for panels with a locking in a resilient material. The multiple vertical lockings may decrease the risk of unlocking and a separation of the first 1 and second 2 edges.

Figure 2A:
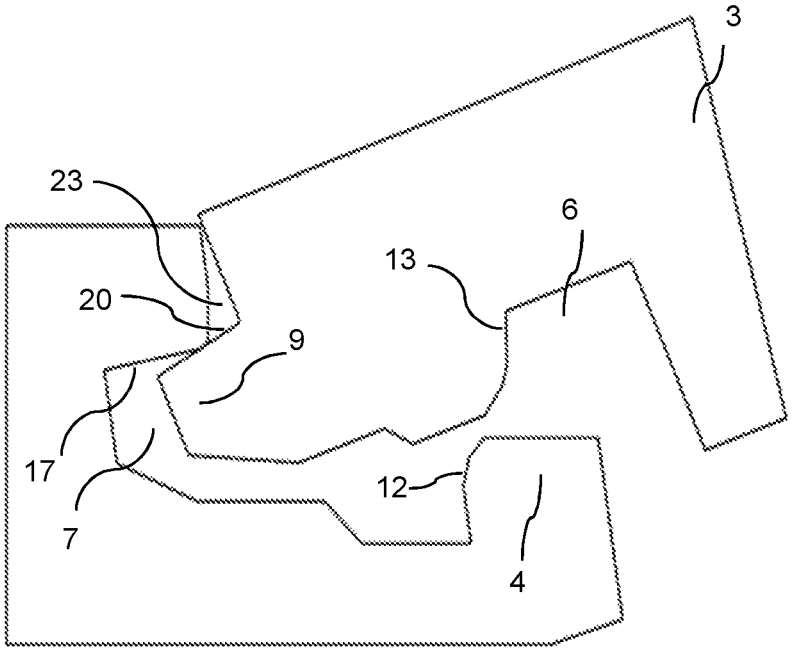
FIGS. 2A-2C show an embodiment of an assembling of an embodiment of a set of panels according to the invention, in which a first edge of a first panel and a third edge of a second panel are assembled.
Figure 2B:
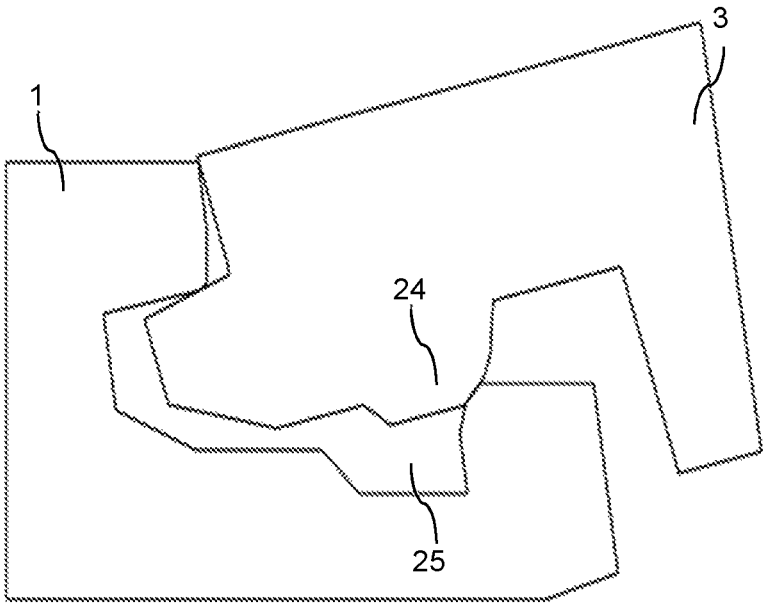
Figure 2C:
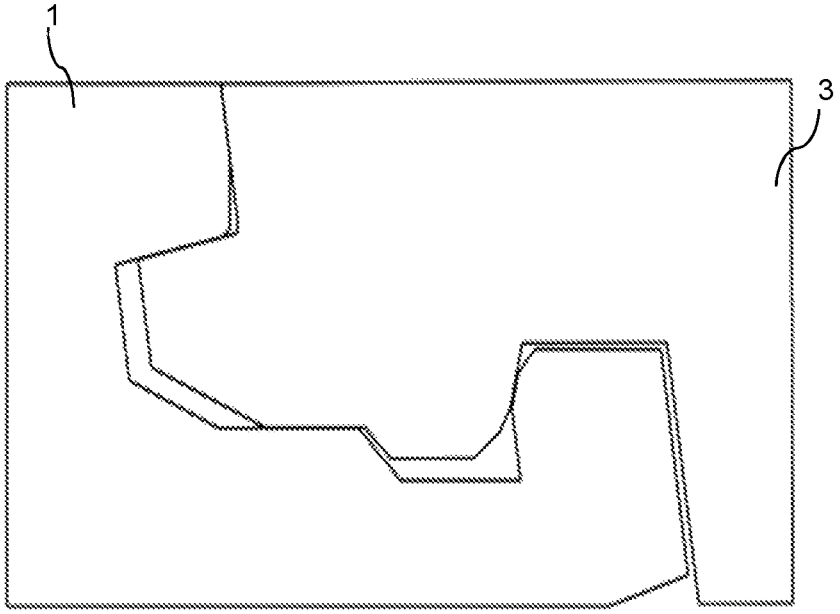

An embodiment of the invention is shown during assembling in FIGS. 2A-2C. The embodiment comprises a set of panels comprising a first panel 41 and a second panel 42, wherein a first edge 1 of the first panel 41 and a third edge 3 of the second panel 42 are configured to be locked together and assembled by an angling motion of the third edge 3 of the second panel 42 relative to the first edge 1 of the first panel 41.

The first edge 1 comprises a first locking element 4 which is configured to be able to cooperate with a second locking groove 6 at the third edge 3, for locking in a horizontal direction.

The first edge 1 also comprises a tongue groove 7 which is configured to cooperate with a tongue 9 at the third edge 3, for locking in a vertical direction. Further, the first locking element 4 comprises a third locking surface 12 which is configured to cooperate with a fourth locking surface 13 on the second locking groove 6, for locking in the horizontal direction.

The third locking surface 12 may be parallel or essentially parallel to the fourth locking surface 13.

The tongue 9 may comprise an upper locking surface 20 which is configured to cooperate for locking in a vertical direction with the lower locking surface 17 of the upper lip 26 of the tongue groove 7.

The third edge 3 may comprise a third locking element 24 configured to cooperate with a third locking groove 25 on the first edge 1 for locking in a horizontal direction.

The third edge 3 may be assembled to the first edge 1 by an angling motion, which is shown in FIGS. 2A and 2B.

The horizontal lockings as specified above may be an advantage, especially for panels with a locking in a resilient material. The multiple horizontal lockings may decrease the risk of unlocking and a separation of the first 1 and third 3 edges.

A locked position of the first edge 1 and the third edge 3 is shown in FIG. 2C.

The first locking surface 10 is positioned below the third locking surface 12.

The third locking surface 12 is positioned below the third guiding surface 18.

Enlargements of the first locking element 4 are shown in FIGS. 6A-6E.

An angle 31 between the first 10 and third 12 locking surface may be within the range of about 5° to about 30°, preferably within the range of about 10° to about 25°, or preferably about 17°.

An angle 32 between the third locking surface 12 and third guiding surface 18 may be within the range of about 10° to about 40°, preferably within the range of about 20° to about 30°, or preferably about 25°.

An angle 33 between the first locking surface 10 and an upper surface of the first 41 or second 42 panel may be within the range of about 70° to about 85°, preferably within the range of about 75° to about 80°, or preferably about 77°.

An angle 34 between the third locking surface 12 and an upper surface of the first 41 or second 42 panel may be within the range of about 50° to about 85°, preferably within the range of about 60° to about 75°, or preferably about 67°.

An angle 35 between the third guiding surface 18 and an upper surface of the first 41 or second 42 panel may be within the range of about 25° to about 60°, preferably within the range of about 35° to about 50°, or preferably about 42°.

The set of panels according to embodiments of the present invention may provide an increased locking strength of the panels due to the multiple locking surfaces. An improved locking together of the panels may be critical for keeping the panels in position, also when being subject to forces by subject matter in motion on the panels.

The set of panels according to embodiments of the present invention may also be easier to assemble compared to known sets of panels due to the guiding surfaces. An improved guiding may be critical for assembling panels having surfaces with a high friction and particularly, if the panel edges comprise a less elastic material. Without the improved guiding such panels may be difficult to assemble or the panels or part of the panel, e.g., the tongue may break during the assembling. The set of panels according to embodiments of the present invention also provide a more compact junction between panels and thereby a reduced amount of panel material going to waste.

Figure 4A:
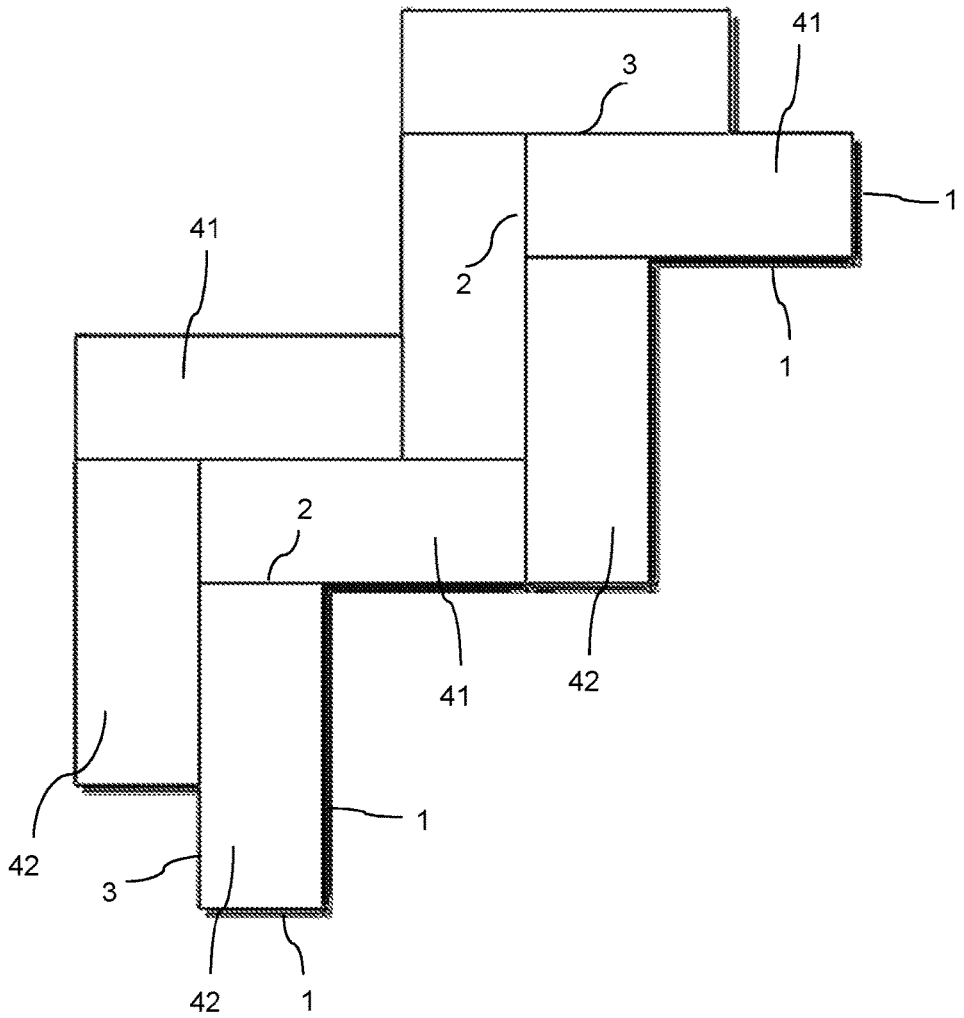
FIGS. 4A-4B show an embodiment of a set of panels according to the present invention, in which the panels are assembled in a herringbone pattern.
Figure 4B:
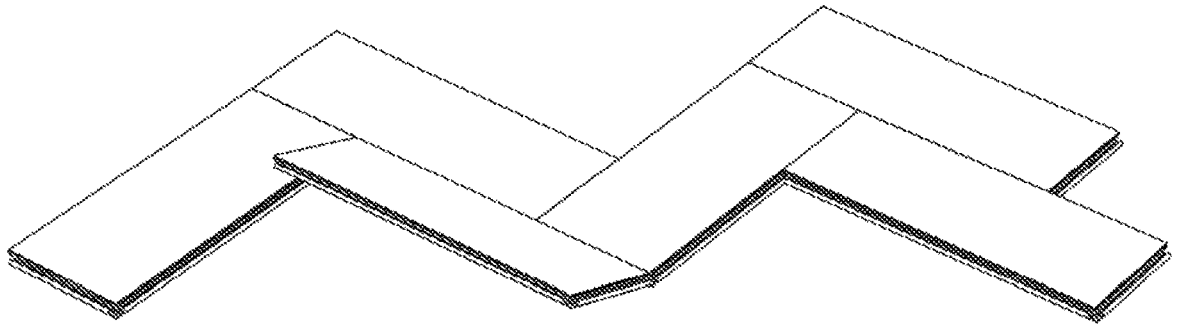

The set of panels according to embodiments of the present invention may be assembled in different patterns. One example is a herringbone pattern, wherein a first 41 and second 42 panel are assembled, as shown in FIGS. 4A-4B. When assembling the panels in a herringbone pattern, the second edge 2 of the second panel 42 is to be connected vertically to the first edge 1 of the first panel 41.

Figure 5A:
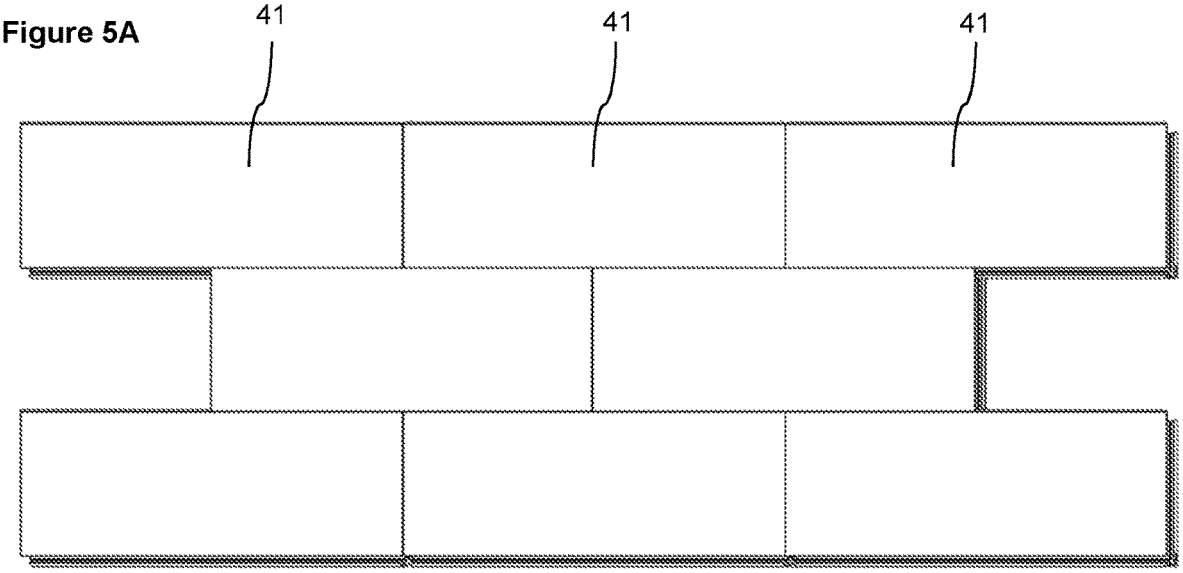
FIGS. 5A-5B show an embodiment in which panels according to the present invention are assembled in a modular pattern, i.e., parallel to each other. When assembling the panels in a modular pattern either only multiples of the first panel or only multiples of the second panel are to be connected to each other.
Figure 5B:
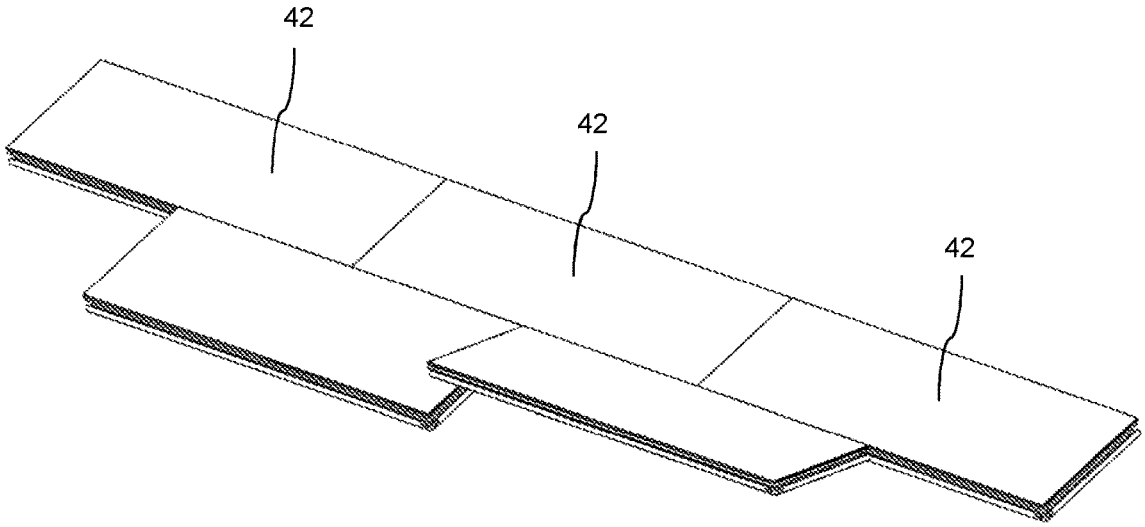
Figure 6A:
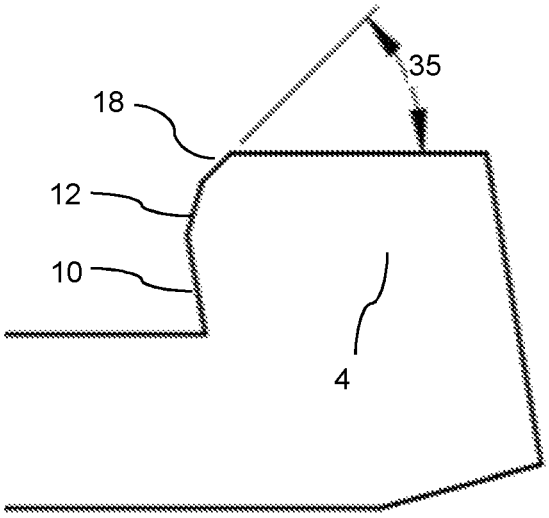
FIGS. 6A-6E show enlargements of the first locking element, illustrating angles between the different surfaces of the first locking element and also angles between the surfaces of the first locking element and an upper surface of the first or second panel.
Figure 6B:
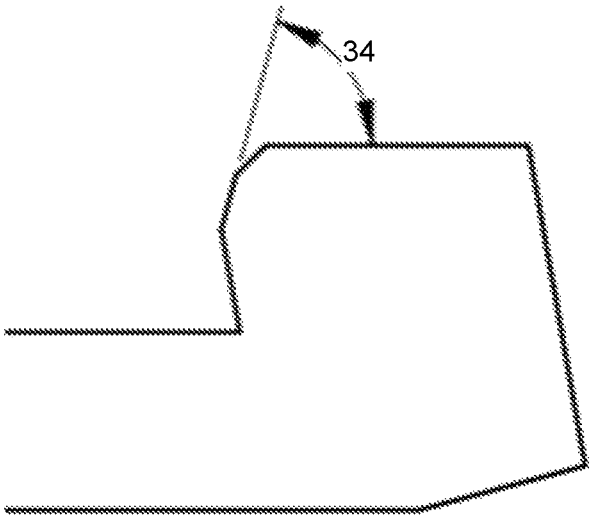
Figure 6C:
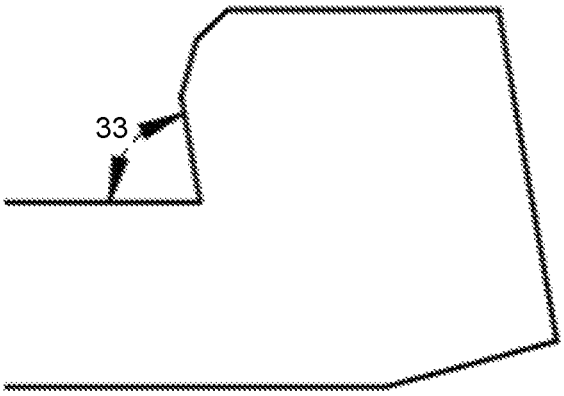
Figure 6D:
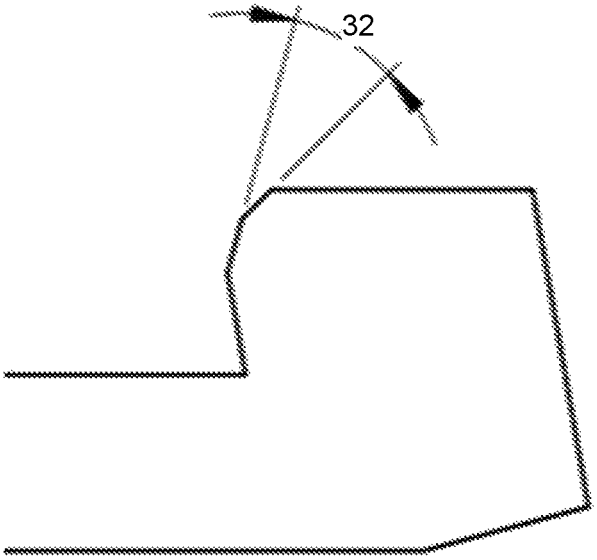
Figure 6E:
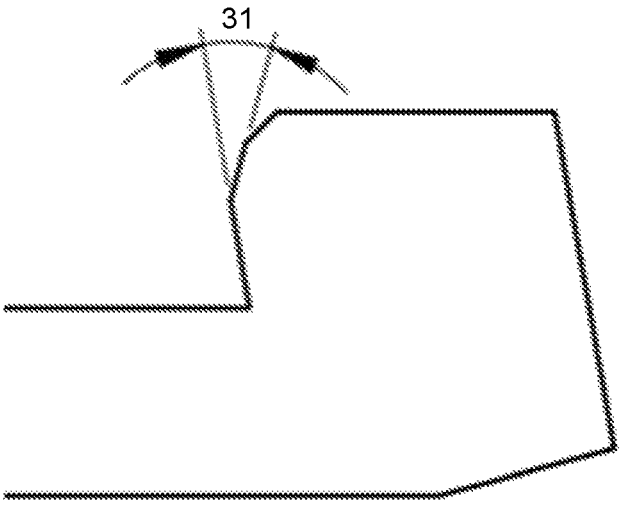

Another example is a modular pattern, in which the panels are assembled parallel to each other, as shown in FIGS. 5A-5B. When assembling the panels in a modular pattern either only multiples of the first panel 41 or only multiples of the second panel 42 are to be connected to each other in each row of panels. When assembling the panels in a modular pattern, the first edge 1 of a first panel 41 is connected to the third edge 3 of a first panel 41, or, alternatively, the first edge 1 of a second panel 42 is connected to the third edge 3 of a second panel 42.

The first panel 41 may comprise, in a clockwise direction, the first edge 1, the first edge 1, the second edge 2, and the third edge 3, as shown in FIG. 3A.

The second panel 42 may comprise, in a clockwise direction, the second edge 2, the first edge 1, the first edge 1, and the third edge 3, as shown in FIG. 3B.

The first 41 panel and the second 42 panel may have a thickness in the range of about 3 mm to about 12 mm.

The embodiments described above may be resilient panels. The resilient panels may comprise a core comprising thermoplastic material. The thermoplastic material may be foamed.

The thermoplastic material may comprise polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof. The core may be formed of several layers.

The embodiments described above may comprise a decorative layer, such as a decorative foil comprising a thermoplastic material. The thermoplastic material of the decorative layer may be or comprise polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof. The decorative foil is preferably printed, for example by direct printing, rotogravure, or digital printing.

The embodiments described above may comprise a wear layer such as a film or foil. The wear layer may comprise thermoplastic material. The thermoplastic material may be polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof.

The embodiments described above may comprise a wood base core, such as HDF, MDF or plywood.

The first panel and the second panel may be configured to be disassembled by downwardly rotating the first and/or the second panel.

EMBODIMENTS

1. A set of panels comprising a first panel (41) and a second panel (42), said first (41) and second (42) panel each having a first edge (1), a second edge (2) and a third (3) edge and wherein the first edge (1) of the first panel (41) is configured to be able to be locked together with both the second (2) edge and the third (3) edge, respectively, of the second panel (42), wherein the first edge (1) comprises a first locking element (4) configured to be able to cooperate with a first locking groove (5) at the second edge (2) and a second locking groove (6) at the third edge (3), respectively, for locking in a horizontal direction, wherein the first edge (1) further comprises a tongue groove (7) configured to cooperate with a tongue (8) at the second edge (2) and a tongue (9) at the third edge (3), respectively, for locking in a vertical direction, wherein the first locking element (4) comprises a first locking surface (10) configured to cooperate with a second locking surface (11) on the first locking groove (5), for locking in the horizontal and the vertical direction, and wherein the first locking element (4) comprises a third locking surface (12) which is configured to cooperate with a fourth locking surface (13) on the second locking groove (6) for locking in the horizontal direction.

2. The set of panels according to embodiment 1, wherein an upper part of the first edge (1) comprises a first guiding surface (14) and a lower edge of the tongue (8) of the second edge (2) comprises a second guiding surface (15), configured to cooperate during a vertical displacement (27) of the second edge (2) relative the first edge (1) for assembling the second edge (2) to the first edge (1).

3. The set of panels according to embodiment 1 or 2, wherein the tongue (8) on the second edge (2) comprises an upper locking surface (16) which is configured to cooperate for locking in a vertical direction with a lower locking surface (17) of an upper lip (26) of the tongue groove (7).

4. The set of panels according to any of the embodiments 1 to 3, wherein an upper part of the first locking element (4) comprises a third guiding surface (18) and a lower edge of the first locking groove (5) comprises a fourth guiding surface (19), configured to cooperate during the vertical displacement (27) of the second edge (2) relative to the first edge (1) for assembling the second edge (2) to the first edge (1).

5. The set of panels according to any one of the embodiments 1 to 4, wherein the tongue (9) comprises an upper locking surface (20) which is configured to cooperate for locking in a vertical direction with the lower locking surface (17) of the upper lip (26) of the tongue groove (7).

6. The set of panels according to any one of the embodiments 1 to 5, wherein an angle (31) between the first (10) and third (12) locking surface is within the range of about 5° to about 30°, preferably within the range of about 10° to about 25°, or preferably about 17°.

7. The set of panels according to any one of the embodiments 4 to 6, wherein an angle (32) between the third locking surface (12) and third guiding surface (18) is within the range of about 10° to about 40°, preferably within the range of about 20° to about 30°, or preferably about 25°.

8. The set of panels according to any one of the previous embodiments, wherein the second edge (2) comprises a second locking element (22) and the first edge (1) comprises a third locking groove (25), and wherein the second locking element and the third locking groove are configured to cooperate for locking in a horizontal direction.

9. The set of panels according to any one of the previous embodiments, wherein the third edge (3) comprises a third locking element (24) configured to cooperate with the third locking groove (25) for locking in a horizontal direction.

10. The set of panels according to any one of the previous embodiments, wherein the length of the second edge (2) is shorter than the length of the first edge (1).

11. The set of panels according to any one of the previous embodiments, wherein the second edge (2) of the second panel (42) is to be connected vertically to the first edge (1) of the first panel (41). 12. The set of panels according to any one of the previous embodiments, wherein the first panel (41) comprises, in a clockwise direction, the first edge (1), the first edge (1), the second edge (2), and the third edge (3).

13. The set of panels according to any one of the previous embodiments, wherein the second panel (42) comprises, in a clockwise direction, the second edge (2), the first edge (1), the first edge (1), and the third edge (3).

14. The set of panels according to any one of the previous embodiments, wherein the third edge (3) is configured to be assembled to the first edge (1) by an angling motion.

The invention claimed is:

1. A set of panels comprising a first panel and a second panel, said first and second panel each having a first edge, a second edge and a third edge and wherein the first edge of the first panel is configured to be able to be locked together with both the second edge and the third edge, respectively, of the second panel, wherein the first edge comprises a first locking element configured to be able to cooperate with a first locking groove at the second edge and a second locking groove at the third edge, respectively, for locking in a horizontal direction, wherein the first edge further comprises a tongue groove configured to cooperate with a tongue at the second edge and a tongue at the third edge, respectively, for locking in a vertical direction, wherein the second edge of the second panel is configured to be connected vertically to the first edge of the first panel, wherein the third edge is configured to be assembled to the first edge by an angling motion, wherein the first locking element comprises a first locking surface which is configured to cooperate with a second locking surface on the first locking groove, wherein the first locking element comprises a third locking surface which is configured to cooperate with a fourth locking surface on the second locking groove, for locking in the horizontal direction, and wherein the first locking surface is positioned below the third locking surface.

2. The set of panels according to claim 1, wherein the first locking first locking surface is configured to cooperate with the second locking surface on the first locking groove, for locking in the horizontal and the vertical direction.

3. The set of panels according to claim 1, wherein an upper part of the first edge comprises a first guiding surface and a lower edge of the tongue at the second edge comprises a second guiding surface, configured to cooperate during a vertical displacement of the second edge relative the first edge for assembling the second edge to the first edge.

4. The set of panels according to claim 1, wherein the tongue at the second edge comprises an upper locking surface which is configured to cooperate for locking in a vertical direction with a lower locking surface of an upper lip of the tongue groove.

5. The set of panels according to claim 1, wherein an upper part of the first locking element comprises a third guiding surface and a lower edge of the first locking groove comprises a fourth guiding surface, configured to cooperate during the vertical displacement of the second edge relative to the first edge for assembling the second edge to the first edge.

6. The set of panels according to claim 1, wherein the tongue at the third edge comprises an upper locking surface which is configured to cooperate for locking in a vertical direction with the lower locking surface of the upper lip of the tongue groove.

7. The set of panels according to claim 1, wherein an angle between the first and third locking surface is within the range of about 5° to about 30°.

8. The set of panels according to claim 5, wherein an angle between the third locking surface and third guiding surface is within the range of about 10° to about 40°.

9. The set of panels according to claim 1, wherein the second edge comprises a second locking element and the first edge comprises a third locking groove, and wherein the second locking element and the third locking groove are configured to cooperate for locking in a horizontal direction.

10. The set of panels according to claim 1, wherein the third edge comprises a third locking element configured to cooperate with the third locking groove for locking in a horizontal direction.

11. The set of panels according to claim 1, wherein the length of the second edge is shorter than the length of the first edge.

12. The set of panels according to claim 1, wherein the first panel comprises, in a clockwise direction, the first edge, the first edge, the second edge, and the third edge.

13. The set of panels according to claim 1, wherein the second panel comprises, in a clockwise direction, the second edge, the first edge, the first edge, and the third edge.

14. The set of panels according to claim 1, wherein the panels are resilient panels.

15. The set of panels according to claim 14, wherein the resilient panels comprises a core comprising thermoplastic material.

16. The set of panels according to claim 15, wherein the thermoplastic material comprise polyvinyl chloride (PVC), polyester, polypropylene (PP), polyethylene (PE), polystyrene (PS), polyurethane (PU), polyethylene terephthalate (PET), polyacrylate, methacrylate, polycarbonate, polyvinyl butyral, polybutylene terephthalate, or a combination thereof.

17. The set of panels according to claim 15, wherein the thermoplastic material is foamed.

18. The set of panels according to claim 1, wherein the panels comprise a wood-based core.

19. The set of panels according to claim 1, wherein the tongue at the second edge protrudes from the second edge in a first protrusion direction and being configured for insertion into the tongue groove for locking in the vertical direction, and the tongue at the third edge protrudes from the third edge in a second protrusion direction and being configured for insertion into the tongue groove for locking in the vertical direction.

20. The set of panels according to claim 19, wherein a total length of the tongue at the second edge in the first protrusion direction being different from a total length of the tongue at the third edge in the second protrusion direction.

* * * * *